US005288942A

United States Patent [19]

Godfrey

[11] Patent Number: 5,288,942

[45] Date of Patent: Feb. 22, 1994

[54] CARDHOLDERS INCORPORATING KEEPERS

[76] Inventor: Richard L. Godfrey, Westfield, Portsmouth Road, Milford, Godalming, Surrey, GU8 5DS, England

[21] Appl. No.: 730,793

[22] PCT Filed: Jul. 19, 1990

[86] PCT No.: PCT/GB90/01044

§ 371 Date: Jul. 24, 1991

§ 102(e) Date: Jul. 24, 1991

[87] PCT Pub. No.: WO91/17680

PCT Pub. Date: Nov. 28, 1991

[30] Foreign Application Priority Data

May 14, 1990 [GB] United Kingdom ..... 9010778

[51] Int. Cl.[5] ..... H05K 9/00; A45C 11/18

[52] U.S. Cl. ..... 174/35 R; 174/35 MS; 150/147; 150/149

[58] Field of Search ..... 174/35 R, 35 MS; 150/147, 152, 146, 148, 149

[56] References Cited

U.S. PATENT DOCUMENTS 2,269,149 1/1942 Edgar .
2,353,550 7/1944 de Forest et al. .
4,593,736 6/1986 Morita .
4,632,250 12/1986 Ueda et al. .
4,851,610 7/1989 LeBlanc et al. .

FOREIGN PATENT DOCUMENTS 2631091 1/1978 Fed. Rep. of Germany .

*Primary Examiner*—Leo P. Picard
*Assistant Examiner*—Bot Lee Ledynh
*Attorney, Agent, or Firm*—Nikaido, Marmelstein, Murray & Oram

[57] ABSTRACT

In the technical field of known cardholders for devices such as cards with magnetic stripes on which is encoded information and or data in the form of patterns of magnetism, the known cardholders offer no method of 'keeping' (in magnetism terminology) the magnetic patterns. The present invention is characterised by incorporating into the cardholders, keepers in the form of sheets of magnetically soft ferromagnetic material with high resistance. The benefit of the invention is obtained when devices are placed with the reading surface of their magnetized stripes in close contact with the surface of the ferromagnetic material which, making use of known properties of the material, then acts as keeper of the magnetic patterns.

23 Claims, 7 Drawing Sheets

CARDHOLDERS INCORPORATING KEEPERS

TECHNICAL FIELD

In the technical field of holders for devices on which information and/or data is encoded in the form of patterns of magnetism, the present invention concerns a method of 'keeping' (in magnetism terminology) the said magnetic patterns. The term 'patterns' includes any arrangement of magnetism such as regular or irregular lines, dots, waves, areas of magnetism, areas of reversed polarity and unmagnetised areas.

The encoding of information and/or data in the form of magnetic patterns is well known and widely used, a typical device making use of this principle being the card containing one or more magnetic stripes. Such devices are widely used as credit cards, charge cards, cash dispenser cards, security cards and fare tickets and for many similar applications. It is known that extraneous magnetic fields have a deleterious effect on the said devices and there are known methods of shielding against such effects. A good shield should completely surround but not make contact with the device being protected.

Possibly not so well known is the fact that the magnetic patterns are subject to gradual degradation due to the natural thermal activity and slowing down of the magnetic spin of the molecules of the magnetised material. Such degradation can be reduced by the use of 'keepers' to establish low reluctance paths to enable the magnetic lines of force to complete their natural circuits. To achieve this result a keeper should be in close contact with the face of the device from which lines of magnetism, emanate, i.e. the face from which the encoded information is read.

BACKGROUND ART

Credit cards and similar devices are normally carried around in holders of some sort. Known cardholders are designed to protect the tangible substance of the devices and some cardholders offer shielding against extraneous magnetic fields. Known cardholders do not provide any means of 'keeping' the information and/or data encoded on the magnetic stripes.

Cardholders may be designed for the sole purpose of carrying the devices, may be attached to a garment or may be part of a more comprehensive multi-purpose holder such as a wallet, pocketbook, handbag, purse, belt, bum-bag, tum-bag, briefcase, file (personal, hand held or otherwise) or anything else into which the devices may be placed, carried or stored.

As further background art, it is well known that magnetically soft ferromagnetic material has the properties of low reluctance, low remanent magnetism, high relative permeability, and a narrow hysteresis loop and that the said material provides a ready path for magnetic lines of force. A well known use of these properties is in keepers for permanent magnets. Known ferromagnetic materials are manufactured in many forms, including sheet, strip, granules, powders and composites with other materials.

DISCLOSURE OF THE INVENTION

According to the present invention, keepers in the form of thin sheets or foils of magnetically soft ferromagnetic material are incorporated or inserted into cardholders for devices on which information and/or data is encoded or stored as patterns of magnetism. The said sheets or foils are of suitable size and shape for the said devices and cardholders are designed so that the magnetised reading surfaces of the said devices are held in close contact with the surfaces of the said keepers. The purpose of the keepers is to keep the said magnetic patterns in good condition.

In addition to the known inherent properties of the magnetically soft ferromagnetic material, the keepers are made so that they have a high resistance to eddy currents in order to minimise any magnetic fields induced by movement of the devices. The additional property of high resistance may be received by known methods of formulation of the ferrogmatnetic material and/or composites to obtain high resistivity or by known methods of fabrication of the sheets.

The benefit of the invention is obtained when devices, such as credit cards, are inserted into the cardholders with the reading surfaces of their magnetized components in close contact with the surfaces of the keepers. To avoid physical damage to the magnetized components, the keepers having a smooth, low friction and/or lubricated surface finish.

BEST MODE FOR CARRYING OUT THE INVENTION

Figure 2:
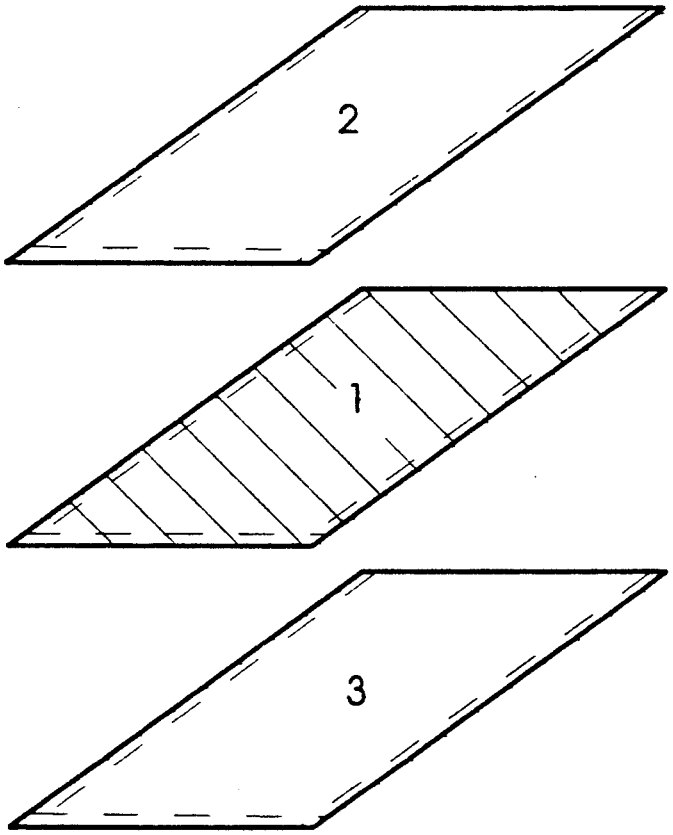
FIG. 2 illustrates an embodiment of the invention in the form of a cardholder which can be made using a keeper and two covers.

The best mode for carrying out the invention is a cardholder for two credit cards. In FIG. 2, part 1 is the keeper, a first embodiment of said keeper being a composite sheet 0.1 mm thick with a smooth, low friction surface finish. The sheet composition is a fine powder of magnetically soft iron, a polymer such as pvc or polyethylene and a suitable binder, making a material of high resistivity. The soft iron powder content is as high as possible consistent with the requirements of mechanical strength and smooth surface finish of the sheet.

The sheet is homogeneous but an alternative would be a polymer substrate coated on both sides with the ferrogmagnetic material in a suitable binder. The technology for fabrication of this type of sheet is well known, for example in the manufacture of recording tape and computer floppy discs (which, incidentally, use magnetically hard material).

The outer covers (parts) 2 and 3 are covers made of 0.05 mm thick transparent pvc and may be attached by glueing, welding, stitching or whatever is best suited to the method of manufacture. (Note that known cardholders consist of parts 2 and 3 only).

To carry out the invention, in both embodiments the three parts are fixed together along the bottom and on two sides (as indicated by dashed lines in the drawing) leaving the top end open for insertion of the cards. To make insertion easier, part 1 projects slightly farther at the open end than parts 2 and 3.

The benefit of the invention is obtained when the cards are inserted, one each side of the keeper, with their magnetic stripes facing and in close contact with the said keeper.

A number of simple cardholders of this type could be strung together in concertina fashion, joined at one end to form a 'book' or built into multi-purpose carriers or storage receptacles. Any other suitable materials could be used for the keeper and/or the covers. For example, a luxury cardholder could be made with tooled leather covers instead of the clear plastic covers.

Figure 1A:
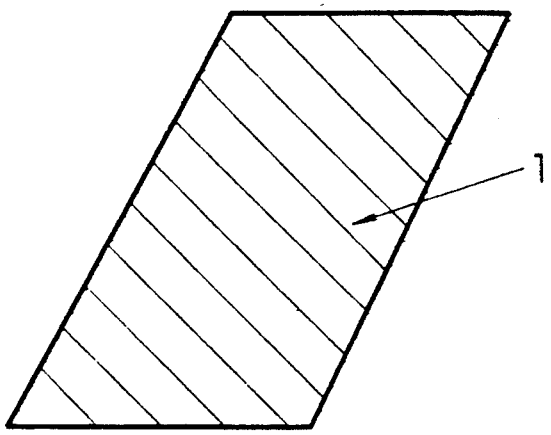
FIG. 1*a* is a perspective view of a keeper which is housed in a cardholder, according to the claimed invention.
Figure 1B:
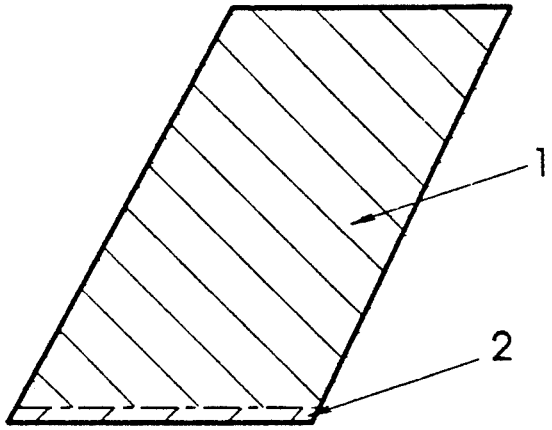
FIG. 1*b* illustrates how adhesive means could be applied to secure the keep in a cardholder.

FIG. 1 shows the basic form of a keeper (1), which is a flat and smooth to ensure the necessary contact or close magnetic proximity to the flat and smooth stripe on a magnetic-stripe card to which it is to function as a keeper. Drawing 1*a* is a plain keeper intended to be housed in a cardholder while drawing 1*b* shows how adhesive means could be applied to secure said keeper in a cardholder.

FIG. 2 shows an embodiment of the invention in the form of a cardholder which can be made using a keeper (1) and two covers (2 and 3) secured, in this example, by fastening means along the bottom and on two sides.

Figure 3:
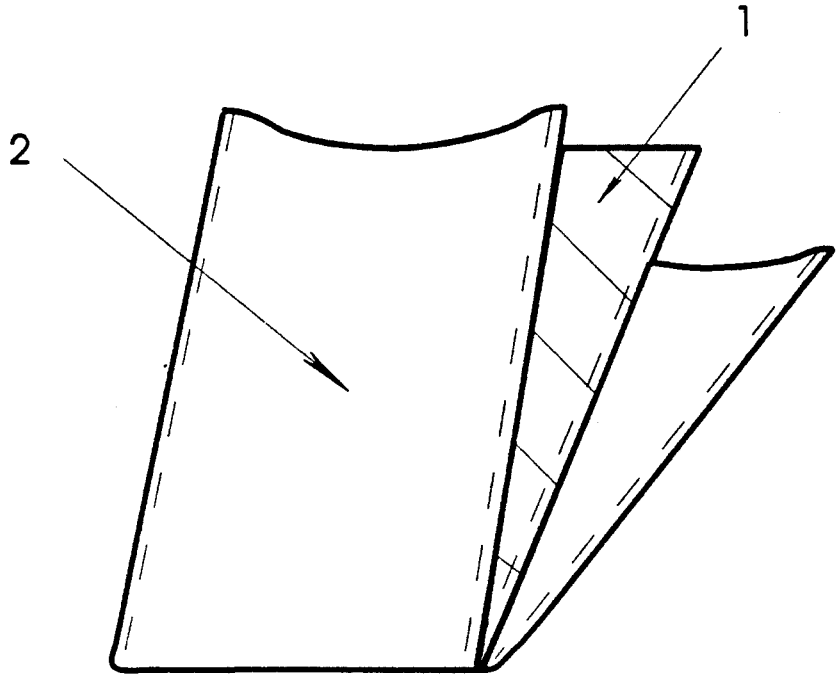
FIG. 3 is a perspective view of an embodiment of the invention employing one keeper and a folded cover.

FIG. 3 shows an embodiment of the invention in the form of a cardholder which can be made using one keeper (1) and a folded cover (2).

Figure 4:
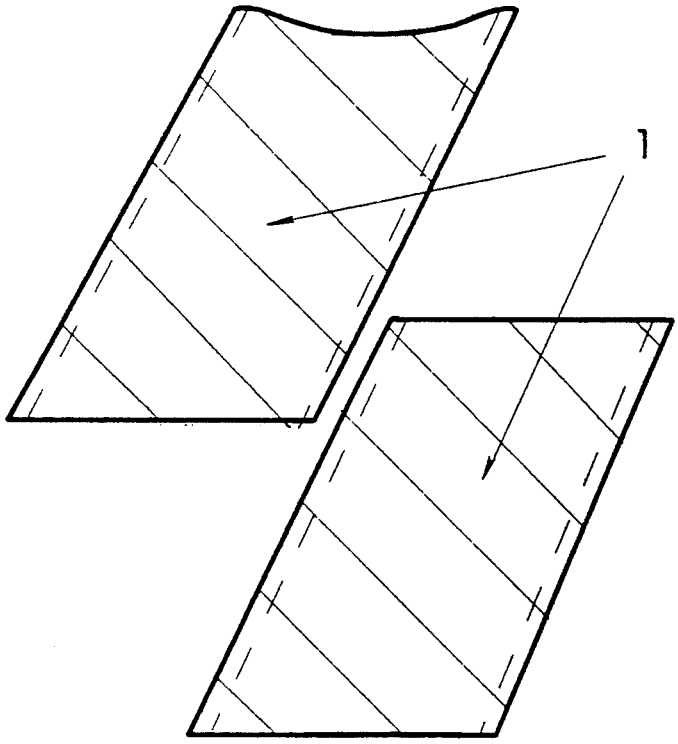
FIG. 4 illustrates an embodiment of the invention in the form of a cardholder which employs two keepers.

FIG. 4 s hows an embodiment of the invention in the form of a cardholder which can be made using two keepers (1).

Figure 5A:
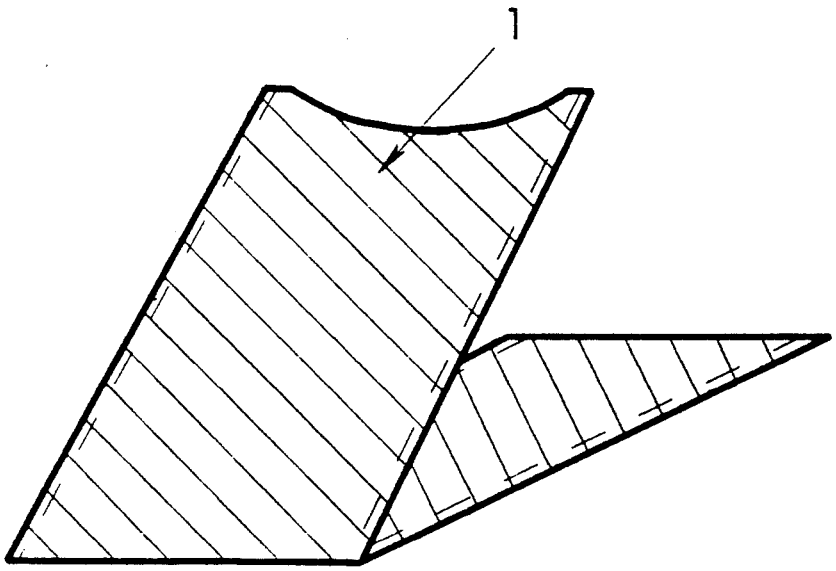
FIG. 5*a* illustrates one keeper sheet being folded to form a single cardholder, according to the present invention.
Figure 5B:
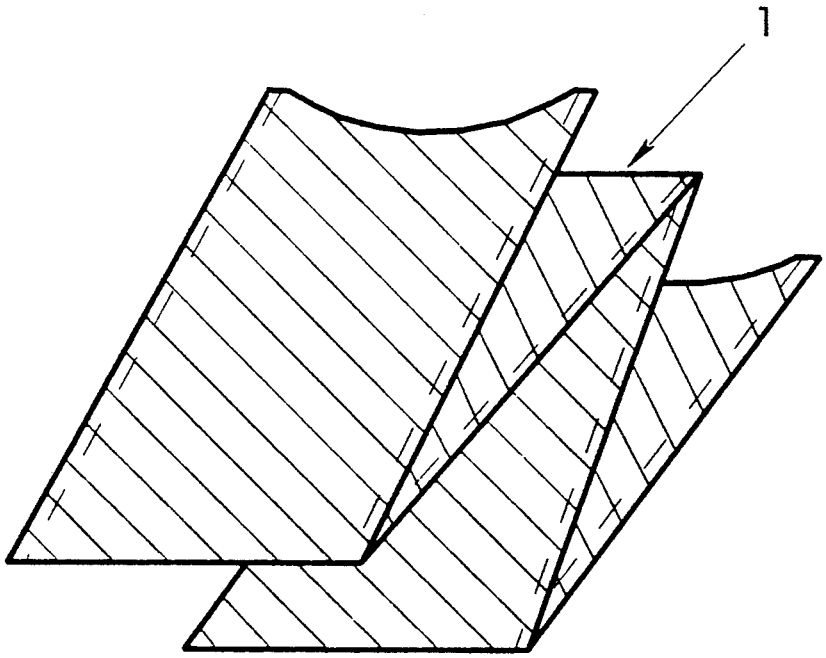
FIG. 5*b* shows a long keeper strip folded to form multiple cardholders, according to the present invention.

FIG. 5 shows an embodiment of the invention in the form of cardholders which can be made using keepers (1) in the form of folded strips. FIG. 5*a* shows a strip folded to form a single cardholder while FIG. 5*b* shows a longer strip folded to form multiple cardholders.

Figure 6A:
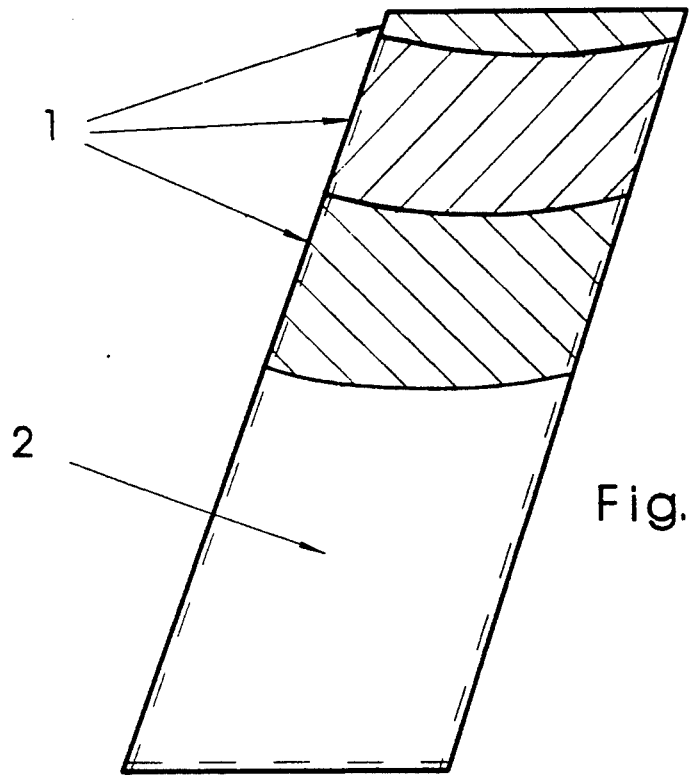
FIGS. 6*a* and 6*b* illustrate an embodiment of the invention wherein cardholders can be made using one or more keeper sheets and covers, to make cardholders with a plurality of pockets therein.
Figure 6B:
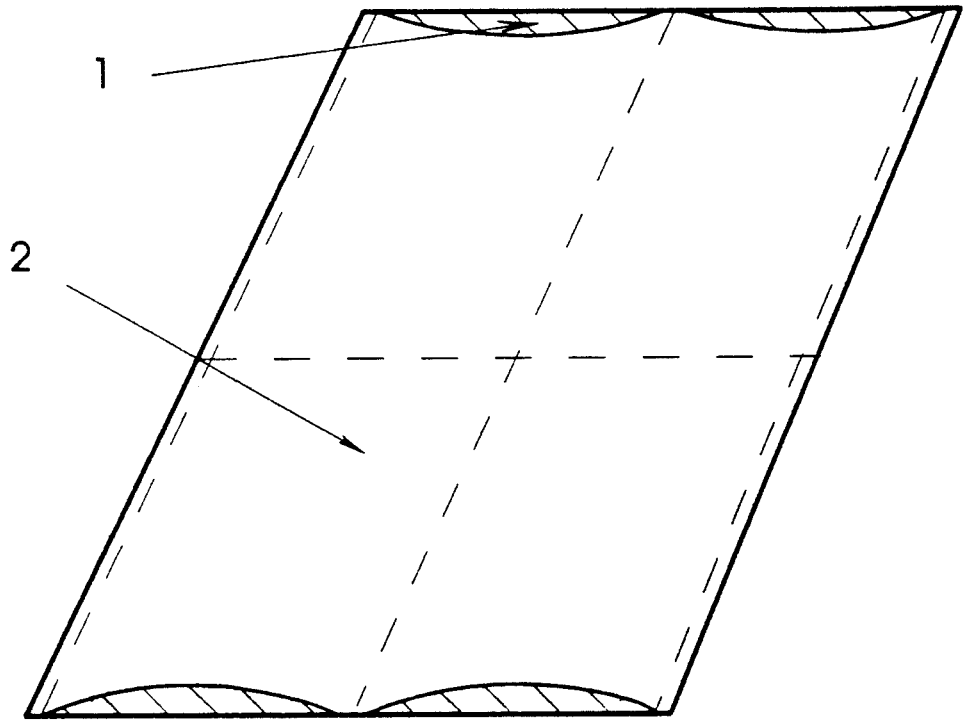

FIG. 6 shows an embodiment of the inventin in the form of cardholders which can be made using one or more keepers sheets (1) (of which the ends are visible) and covers (2) to make cardholders with a plurality of pockets. FIGS. 6*a* and 6*b* show two of the different arrangements possible.

Figure 7:
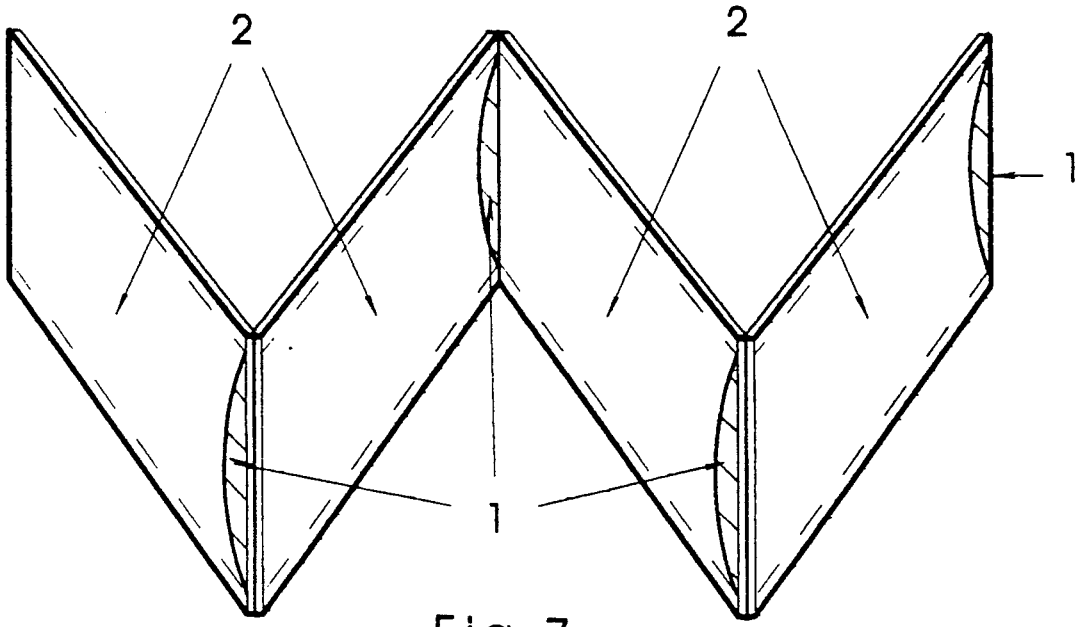
FIG. 7 illustrates an embodiment of the invention in the form of a number of complete cardholders which include keepers joined to form a folding concertina of cardholders.

FIG. 7 shows an embodiment of the invention in the form of a number of complete cardholders, each consisting of keeper (1) (of which the ends are visible) and covers (2), joined to form a folding concertina of cardholder incorporating keepers.

Figure 8:
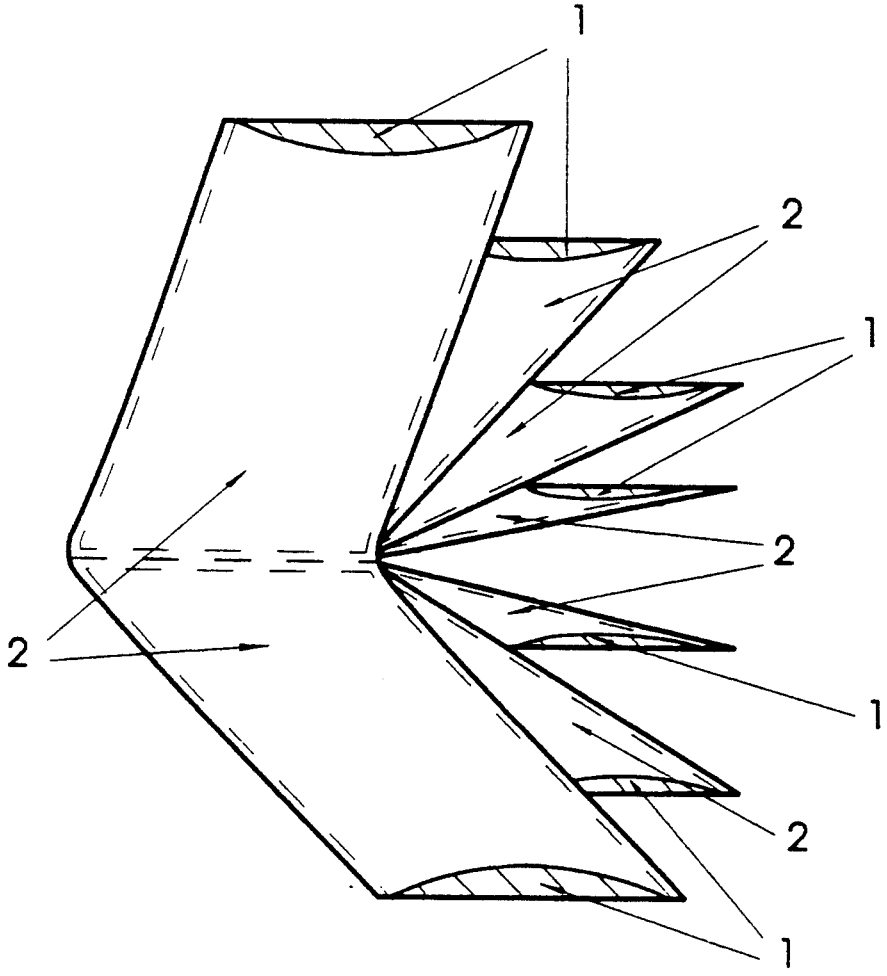
FIG. 8 illustrates an embodiment of the invention wherein a number of complete cardholders each consist of keepers and covers joined to form a book of cardholders incorporating keepers.
Figure 9A:
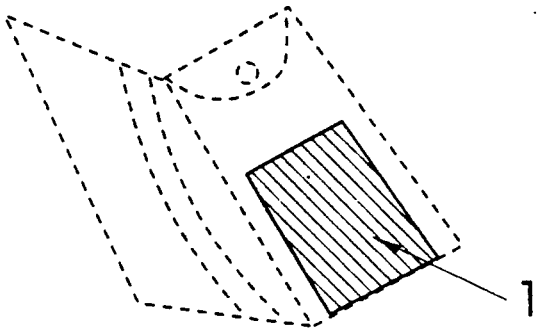
FIGS. 9*a*–9*e* illustrate a number of multi-purpose holders according to the present invention, which employ magnetic keepers.
Figure 9B:
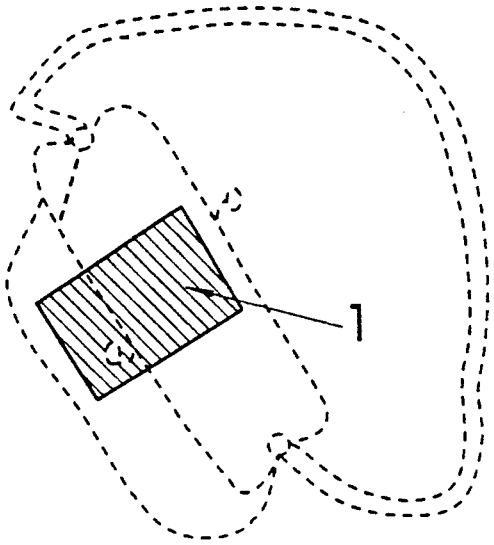
Figure 9C:
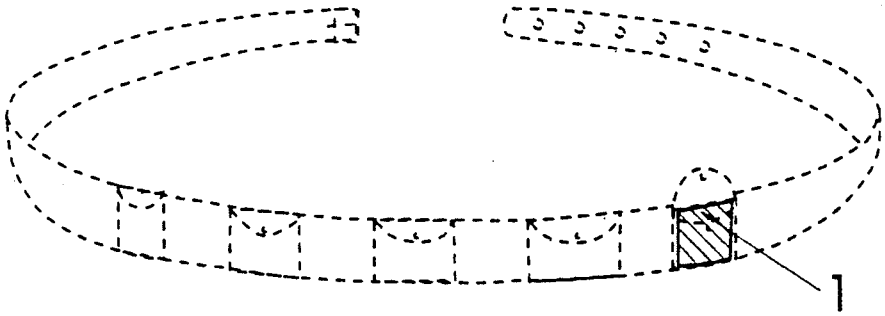
Figure 9D:
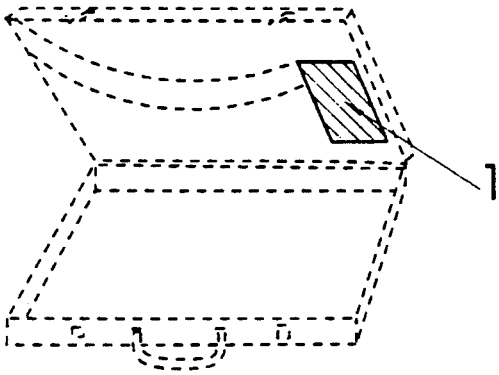
Figure 9E:
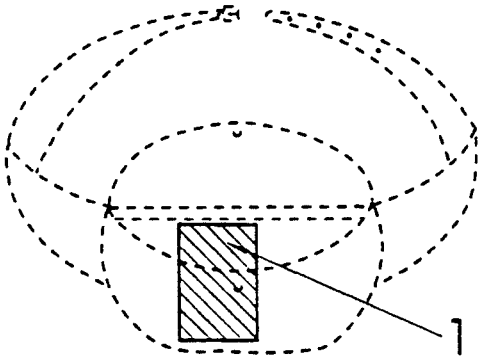

FIG. 8 shows an embodiment of the invention in the form of a number of complete cardholders, each consisting of keepers (1) (of which the ends are visible) and covers (2), joined to form a book of cardholders incorporating keepers.

FIG. 9 shows some typical embodiments of the invention in the form of one or more complete cardholders incorporating keepers (1), of any of the types shown in FIGS. 1 to 8, being secured either by fastening means or releasably into a garment or multipurpose holder. FIG. 9*a* shows how cardholders incorporating keepers (1) can be secured into wallets or pocketbooks. FIG. 9*b* shows how cardholder incorporating keepers (1) can be secured in a handbag of purse. FIG. 9*c* shows how cardholders incorporating keepers (1) can be secured in one or more of the pockets in a moneybelt. FIG. 9*d* shows how cardholders incorporating keepers (1) can be secured in a briefcase. FIG. 9*a* shows how cardholders incorporating keepers (1) can be secured in a bum-bag or tum-bag.

Figure 10:
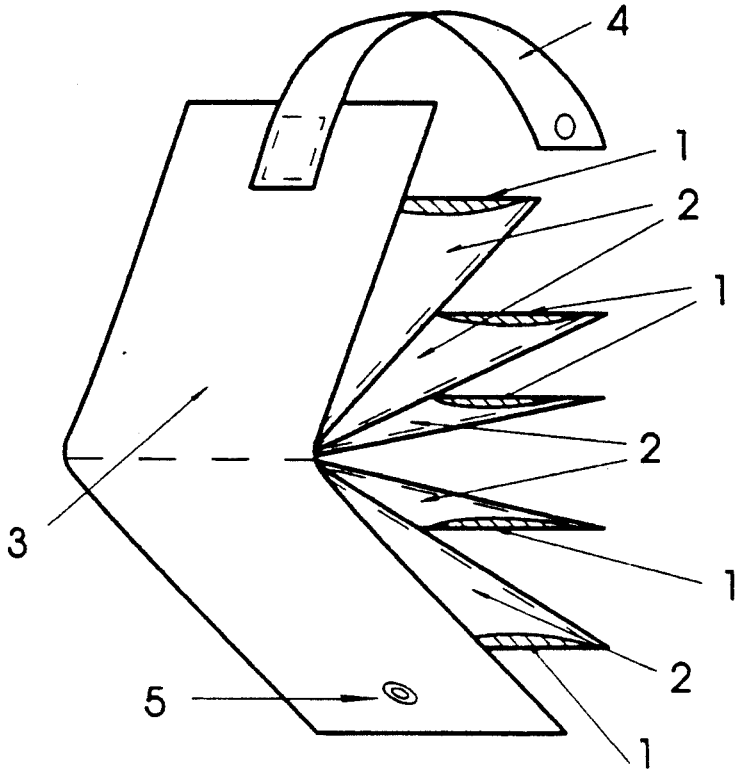
FIG. 10 illustrates an embodiment of the invention wherein a number of complete cardholders are joined to form a book of cardholders incorporating keepers, with at least one flap and a releasable fastening.

FIG. 10 shows an embodiment of the invention in the form of a number of complete cardholders, each consisting of keepers (1) (of which the ends are visible), and covers (2), joined to form a book of cardholders incorporating keepers, inside a third cover (3) with a releasable fastening in the form of a strap (4) and pressstud (5) to secure the book of cardholders in a closed position.

Figure 11:
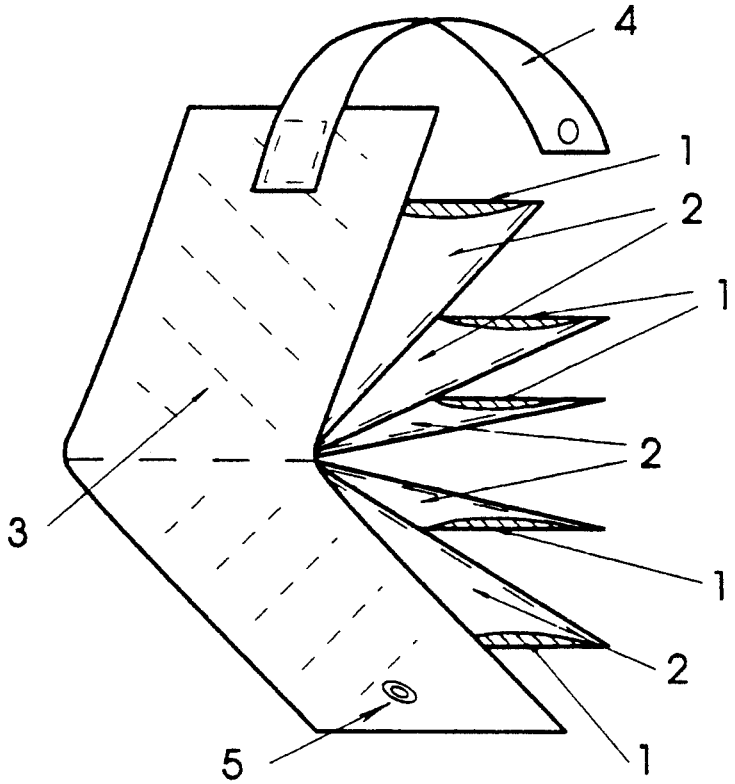
FIG. 11 discloses a cardholder according to the present invention which incorporates decoration applied thereto.

FIG. 11 shows an embodiment of the inventin in the form of a number of complete cardholders, each consisting of keepers (1) (of which the ends are visible), and covers (2), joined to form a book of cardholders incorporating keepers, inside a decorative third cover (3), with a releasable fastening in the form of a strap (4) and press-stud (5) to secure the book of cardholders in a closed position.

INDUSTRIAL APPLICABILITY

Users of credit cards and similar devices with information and/or data encoded as patterns of magnetism would benefit from having holders which keep the said magnetic patterns in good condition. Cardholders made in accordance with the present invention are easily manufactured and would find widespread use in the domestic market, in banking, security, commerce and industry.

I claim:

1. A cardholder incorporating at least one sheet of magnetically soft ferromagnetic material, wherein each of said at least one sheet is a keeper means for maintaining at least one pattern of magnetism carried in at least one stripe on at least one card to be housed in said cardholder, each sheet being dimensioned to match each at least one stripe relative to which it functions as a keeper, each sheet comprising a magnetically soft ferrogmagnetic material which has a high resistance to eddy currents and having at least one surface which is a smooth, low friction surface, said cardholder being so constructed that a reading surface of each card which is housed therein when in use will normally be in close magnetic proximity the keeper afforded by the sheet.

2. A cardholder as recited in claim 1, wherein said sheet is in a shape of a strip.

3. A cardholder as recited in claim 1, wherein said cardholder is so constructed that a reading surface of each card which is housed therein when in use will normally be in contact with the keeper afforded by the sheet.

4. A cardholder comprising at least one sheet which includes a magnetically soft ferrogmagnetic material which has a high resistance to eddy currents and that has at least one surface which is a smooth, low friction surface, said sheet forming a keeper for at least one pattern of magnetism carried in at least one stripe on at least one card to be housed in said cardholder.

5. A cardholder according to claim 4 wherein adhesive means is provided for securing the sheet which affords a keeper in said cardholder.

6. A cardholder according to claim 4, further comprising at least one keeper sheet and two covers which are secured by fastening means in at least one place on at least one side thereof.

7. A cardholder according to claim 4, further comprising a cover folded to enclose said keeper sheet and secured by fastening means in at least one place on at least one side thereof.

8. A cardholder according to claim 4, further comprising two keeper sheets which are secured by fastening means in at least one place on at least one side.

9. A cardholder according to claim 4, further comprising at least one folded keeper sheet which is secured by fastening means in at least one place on at least one side.

10. A cardholder according to claim 4, further comprising at least one keeper sheet and at least one cover which are secured by fastening means in at least one place on at least one surface to form a plurality of pockets.

11. A cardholder as claimed in claim 4, wherein said cardholder forms one of a plurality of cardholders each of which is secured by fastening means in at lest one place to form a folding concertina strip of cardholders.

12. A cardholder as claimed in claim 4, wherein said card holder forms one of a plurality of cardholders that are each secured in at least one place to 13. A cardholder as claimed in claim 4, said cardholder being secured into a multi-purpose holder selected from the group consisting of a wallet, a pocketbook, a handbag, a purse, a belt, a tote-bag, a bum-bag, a tum-bag, a briefcase, and a file, or any wherein said multi-purpose holder can house at least one card bearing magnetic data.

14. A cardholder as claimed in claim 4, wherein at least one flap is secured by at one end and by releasable fastenings at an opposite end to provide a method of securing said cardholder in a closed position.

15. A cardholder as recited in claim 14, wherein said one end of said flap is secured by releasable fastenings.

16. A cardholder as claimed in claim 4, wherein said cardholder incorporates decoration applied thereto.

17. A cardholder as recited in claim 4, wherein said at least one sheet is in a form of a strip.

18. A cardholder according to claim 4, further comprising at least one keeper sheet and two covers which are secured by fastening means in at least one place on at least one edge thereof.

19. A cardholder according to claim 4, further comprising a cover folded to enclose said keeper sheet, and secured by fastening means in at least one place on at least one edge thereof.

20. A cardholder according to claim 4, further comprising two keeper sheets which are secured by fastening means in at lest one place on at least one edge thereof.

21. A cardholder according to claim 4, further comprising at least one folded keeper sheet which is secured by fastening means in at least one place on at least one edge thereof.

22. A cardholder comprising at least one sheet which includes a magnetically soft ferrogmagnetic material which has a high resistance to eddy currents and that has at least one surface which is a smooth, low friction surface, said sheet forming a keep for at least one pattern of magnetism carried in at least one stripe on at least one card to be housed in said cardholder, said sheet comprising a plurality of sheet portions interconnected by folds.

23. A cardholder according to claim 22, wherein adhesive means is provided for securing each folded portion of said plurality of sheet portions which affords a keeper in said cardholder.

* * * * *

UNITED STATES PATENT AND TRADEMARK OFFICE

CERTIFICATE OF CORRECTION

PATENT NO. : 5,288,942

DATED : February 22, 1994

INVENTOR(S) : Richard L. GODFREY

It is certified that error appears in the above-identified patent and that said Letters Patent is hereby corrected as shown below:

1) In Column 2, Line 13, change "received" to -- achieved --.

2) In Column 2, Line 14, change "ferrogmatnetic" to -- ferromagnetic --.

3) In Column 2, Line 22, change "having" to -- have --.

4) In Column 2, Line 31, change "keep" to -- keeper --.

5) In Column 3, Line 44, before "flat" delete -- a --.

6) In Column 3, Line 58, change "s hows" to -- shows --.

7) In Column 3, Line 66, change "inventin" to -- invention --.

8) In Column 3, Line 68, change "keepers" to -- keeper --.

9) In Column 4, Line 6, change "keeper" to -- keepers --.

10) In Column 4, Lines 7 to 8, change "cardholder" to -- cardholders --.

11) In Column 4, Line 21, change "cardholder" to -- cardholders --.

12) In Column 4, Line 22, change "of" to -- or --.

13) In Column 4, Line 26, change "9a" to -- 9e --.

14) In Column 4, Line 36, change "inventin" to -- invention --.

UNITED STATES PATENT AND TRADEMARK OFFICE

CERTIFICATE OF CORRECTION

PATENT NO. : 5,288,942

DATED : February 22, 1994

INVENTOR(S) : Richard L. GODFREY

It is certified that error appears in the above-identified patent and that said Letters Patent is hereby corrected as shown below:

15) In Column 4, Claim 1, Line 63, change "ferrogmagnetic" to -- ferromagnetic --.

16) In Column 4, Claim 1, Line 68, after "proximity" insert -- to --.

17) In Column 5, Claim 4
Line 9, change "ferrogmagnetic" to -- ferromagnetic --.

18) In Column 5, Claim 11
Line 40, change "lest" to -- least --.

19) In Column 5, Claim 12
Line 44, after "one place to" insert -- form a book of cardholders. --.

20) In Column 6, Claim 14
Line 7, after "secured" delete -- by --.

21) In Column 6, Claim 20
Line 27, change "lest" to -- least --.

UNITED STATES PATENT AND TRADEMARK OFFICE

CERTIFICATE OF CORRECTION

PATENT NO. : 5,288,942

DATED : February 22, 1994

INVENTOR(S) : Richard L. GODFREY

It is certified that error appears in the above-indentified patent and that said Letters Patent is hereby corrected as shown below:

22) In Column 6, Claim 22

Line 34, change "ferrogmagnetic" to -- ferromagnetic --.

23) In Column 6, Claim 22

Line 37, change "keep" to -- keeper --.

Signed and Sealed this

Seventeenth Day of January, 1995

*Attest:*

*Attesting Officer*

BRUCE LEHMAN

*Commissioner of Patents and Trademarks*